United States Patent [19]

Nagai

[11] 4,013,286

[45] Mar. 22, 1977

[54] CARD MAGIC BOX

[75] Inventor: Nobuo Nagai, Yamatokooriyama, Japan

[73] Assignee: Nintendo Co., Ltd., Japan

[22] Filed: Feb. 19, 1976

[21] Appl. No.: 659,554

[30] Foreign Application Priority Data

Sept. 13, 1975 Japan ..... 50-126617

[52] U.S. Cl. ..... 272/8 R

[51] Int. Cl.[2] ..... A63J 21/00

[58] Field of Search ..... 272/8 R, 8 N, 8 D, 27 B; 273/148 R, 148 A, 149 R, 149 P

[56] References Cited

UNITED STATES PATENTS

| | | | |
|---|---|---|---|
| 1,537,446 | 5/1925 | Albert | 273/148 A |
| 1,668,263 | 5/1928 | Blodgett | 272/8 N |
| 2,129,981 | 9/1938 | Alva | 272/8 R |
| 2,608,291 | 8/1952 | Alford | 272/148 A X |

FOREIGN PATENTS OR APPLICATIONS

| | | | |
|---|---|---|---|
| 627,366 | 7/1937 | Germany | 273/149 R |

*Primary Examiner*—Anton O. Oechsle
*Assistant Examiner*—Arnold W. Kramer
*Attorney, Agent, or Firm*—Wenderoth, Lind & Ponack

[57] ABSTRACT

A card magic box for a card trick, which automatically tells the card picked and returned by the audience from the rest of a deck. The magic box comprises a deck of uniformly-dimensioned playing cards, the configuration of which is such that either the top or the bottom edge of each card in the deck being slightly shorter than the other edge, an outer housing which is open at the top for loading and unloading said deck of cards, and an inner case as disposed in said outer housing, said inner case being open at the top and bottom and having side walls defining an internal space which is generally conforming to the shape of the deck and in which said deck is freely movable in a vertical direction, said inner case further having, in said internal space and adjacent its side walls that would face the corresponding longitudinal edges of said deck of playing cards upon loading of the deck into the inner case, a pair of resilient members as juxtaposed at a spaced interval shorter than the longer of said top and bottom edges of said deck.

3 Claims, 9 Drawing Figures

CARD MAGIC BOX

SUMMARY OF THE INVENTION

The present invention relates to a magic box utilizing a deck of playing cards, from which the particular card selected by the audience is automatically identified.

Well known is a card trick such that the audience is suggested to pick out a card from a deck of 52 cards, the top or bottom side of the deck being shorter than the other side, and the magician or swindler reverses the direction of cards remaining in his hand as he requests the audience to return the card picked out and subsequently singles out that particular card from the deck. A playing card provided with different side margins on the reverse side and a card varying in length from one edge to the other are also known.

However, excepting a magician with extraordinary skill, it is difficult for an ordinary person to pick out the inverted card from a deck swiftly enough. Another disadvantage is that picking out a given card simply after shuffling with the rest of cards in the deck would allow the audience to learn the gimmick at once.

It is an object of the present invention is to provide a card magic which can be performed without special skill and even by children.

Another object of the invention is to provide a magic box containing a deck of playing cards, with which any would-be magician may perform the card trick as if the box did it automatically, thereby, enhancing the magical effect of the trick.

Other objects of the present invention will become apparent from the description of preferred embodiments when taken together with the accompanying drawings.

The present invention is therefore directed to a playing card magic box comprising (a) a deck of uniformly-dimensioned playing cards, the configuration of which is such that either the top or the bottom edge of each card is slightly shorter than the other edge, (b) an outer housing which is open at the top for loading or unloading said deck of cards and (c) an inner case as disposed in said outer housing, said inner case being open at the top and bottom and having side walls defining an internal space which is generally conforming to the configuration of the deck and in which said deck is freely movable in a vertical direction, said inner case further having, in said internal space and adjacent its side walls that would face the corresponding longitudinal sides of said deck upon loading thereof into the inner case, a pair of resilient members as juxtaposed at a spaced interval shorter than the longer of said top and bottom edges of said cards.

In the above construction, upon loading of said deck of cards into said inner case, the resilient members do not act upon the cards P positioned the shorter edge down but act exclusively upon the inverted card Q, which is positioned the longer edge down, to support the latter card Q from both sides and raise it (or them when a plurality of inverted (picked) cards are present) automatically as the box is operated as will be described hereinafter.

DETAILED DESCRIPTION OF THE INVENTION

Figure 1:
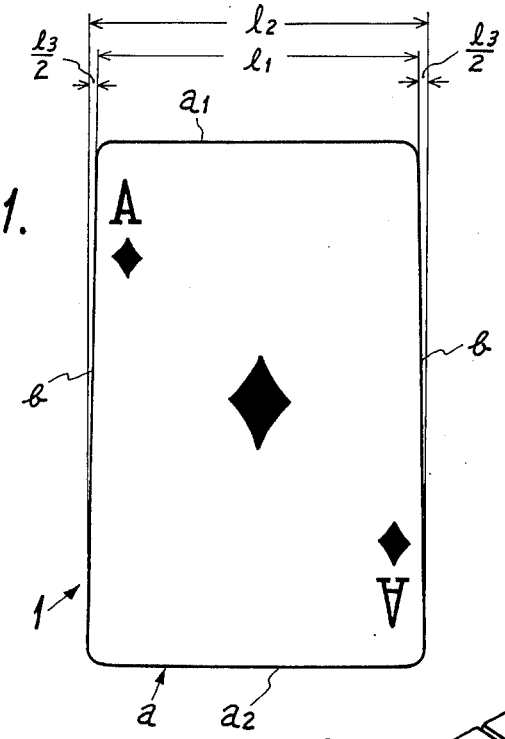
FIG. 1 is an elementary plan view showing one of the playing cards employed according to this invention.

FIG. 1 shows a playing card 1 which is employed in accordance with his invention.

The length $l_1$ of a lateral side $a_1$ of card 1 is slightly shorter than the length $l_2$ of the other lateral side $a_2$, by length $l_3$ (for example, by 0.5mm). The longitudinal edges *b,b* of the card 1 are identical in length. Thus, the configuration of card 1 is not rectangular as is an ordinary playing card but trapezoidal.

Figure 2:
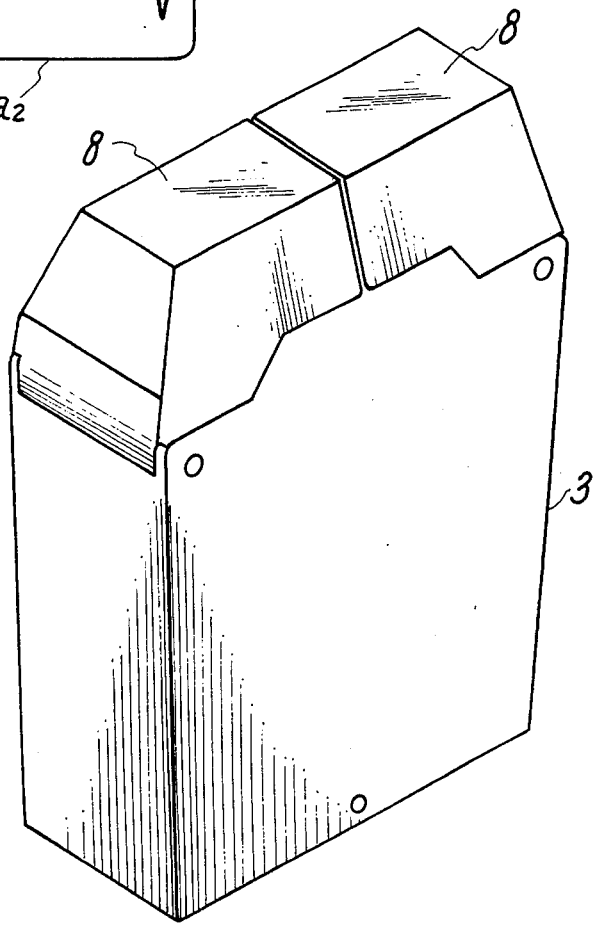
FIG. 2 is a perspective view showing a card magic box embodying the principles of this invention.
Figure 3:
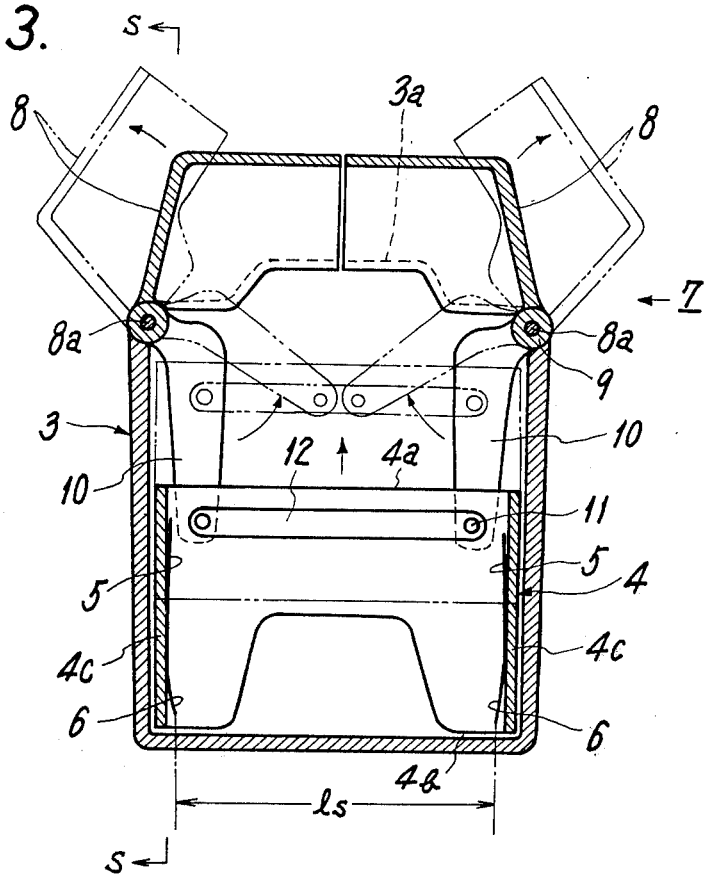
FIG. 3 is a longitudinal cross-section view of the card magic box depicted in FIG. 2.
Figure 4:
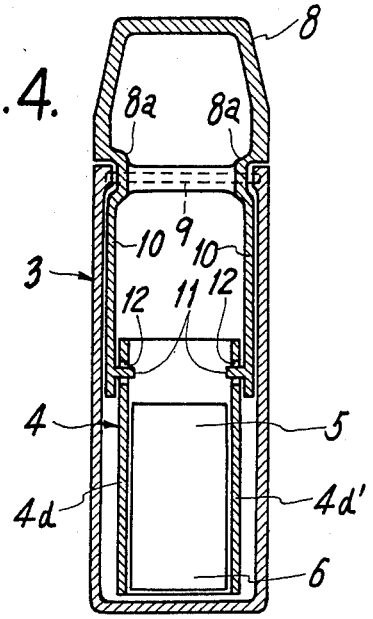
FIG. 4 is a cross-sectional view taken along the line S—S of FIG. 3.
Figure 5:
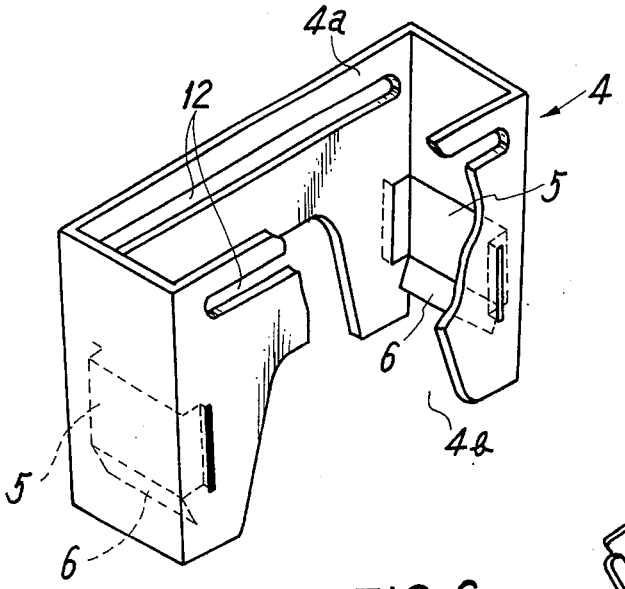
FIG. 5 is a partially exploded perspective view showing the inner case of the card magic box depicted in FIGS. 2 and 3.
Figure 6:
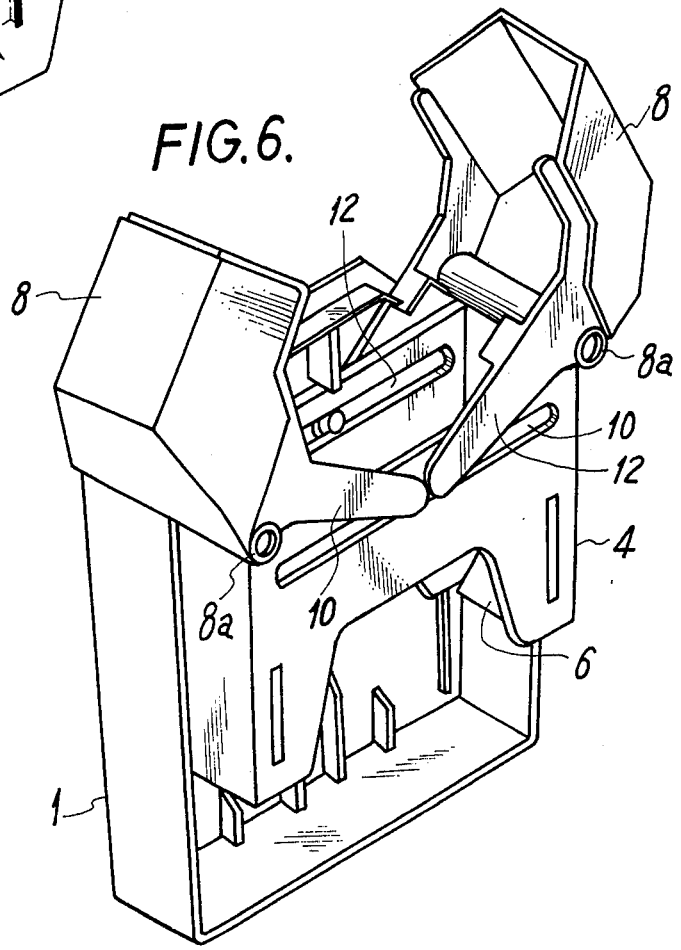
FIG. 6 is a perspective view showing said card magic box with a portion of its outer housing removed and with its cover members in opened position.

In FIGS. 2 through 4 are illustrated a magic box 2 which employs a deck of cards 1 and which automatically identifies and takes out one or more preselected cards from said deck. The magic box 2 essentially comprises a generally box-shaped outer housing 3 which is open at the top 3*a* and an inner case 4 which is open at the top 4*a* and bottom 4*b*, said inner case 4 being accommodated in said outer housing 3 and freely movable therein in a vertical direction as guided by the inner side walls of outer housing 3.

Secured, for example by bonding, to the inner surface of each of the narrower side walls 4*c* of inner case 4 is one end of a plate-shaped resilient member 5 having an adequate degree of resilience or spring action, for example made of phosphobronze, with the other free end of said resilient member 5 being allowed to project downward and slightly displaced or bent inwardly within said inner case 4 to form a gripping member 6.

The distance $l_s$ between the resilient-action parts 6,6 of the resilient pair 5 thus disposed in juxtaposition is shorter than the length $l_2$ of the lateral side $a_2$ of card 1.

Indicated by reference numeral 7 is a mechanism for pulling up the inner case 4.

A pair of cover members 8, respectively, has a base portion 8*a* which is rotatably mounted on a shaft 9 rigidly secured to or adjacent the top of the side wall of outer housing 3, so that said covers 8 will be freely swingable. Integrally formed with said base portion 8*a* is a driving arm 10, and a pin 11 is secured rigidly to the lower end of driving arm 10. The pin 11 traverses a couple of horizontally extending slots 12 provided in the front and rear walls 4*d* and 4*d'*, respectively of inner case 4 so that as the driving arms 10 are caused to move along the slots in response to the swinging action of cover members 8, the inner case 4 is pulled upward.

In another and simplified embodiments, the above mechanism 7 for pulling up the inner case may be omitted. Instead, a window-like cutout is formed through the side wall of outer housing 3 so that inner case 4 may be raised by a finger applied through said cutout against the side wall 4c of inner case 4. However, the first-mentioned embodiment which automatically raises the inner case 4 in response to the swinging (opening) motion of the cover members 8 lends added interest and magical effects to the trick.

Figure 7:
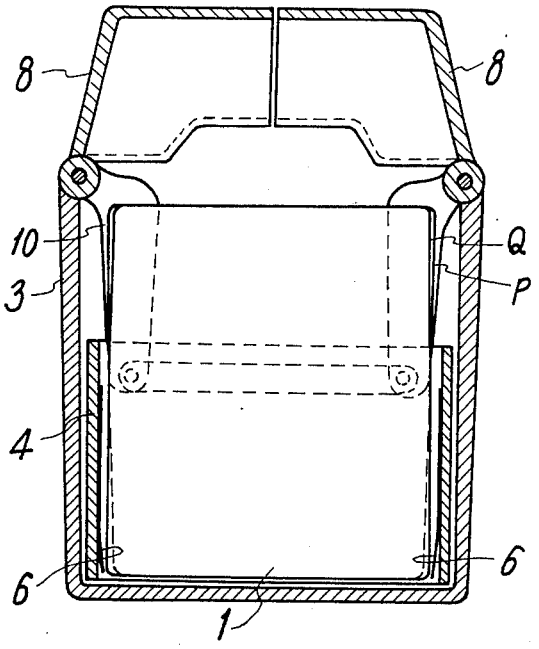
FIG. 7 is a cross-section view similar to FIG. 3
Figure 8:
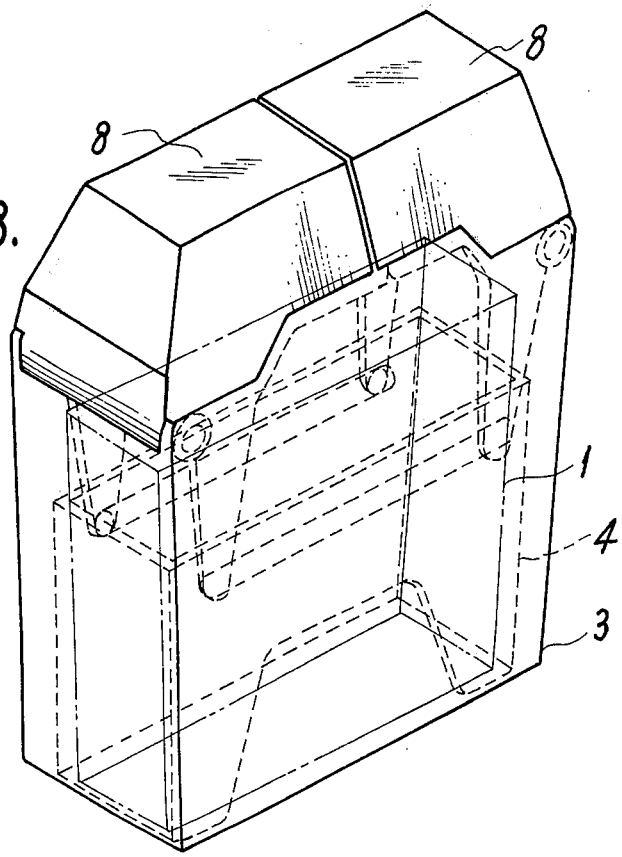
FIG. 8 is a perspective view; both showing the relative position of the inner case in the outer housing when the magic box has been loaded with the deck of playing cards.

In playing a card trick with the magic box of this invention, the would-be magician asks the audience to pick out one or a few optional cards from the deck of cards and, after the audience has memorized the card picked, to return the card to the deck. The trick, infact, lies in that, when the card is returned, it is so arranged by the magician that the particular card will rejoin the deck upside down and, then, the entire deck is replaced in the box, i.e. inner case 4, in such a manner that the rest of the deck, i.e. all the cards excepting the card Q picked and returned, will be placed the shorter lateral side $a_1$ down. Of course, the picked card Q will be positioned the shorter lateral side $a_1$ up. (See FIGS. 7 and 8).

With the deck in the above position, because only the length of the longer lateral side $a_2$ of picked card Q is greater than the distance $l_s$ between the gripping members 6,6 of said resilient members, it is in contact with the resilient-action parts and inwardly pressed thereby.

Figure 9:
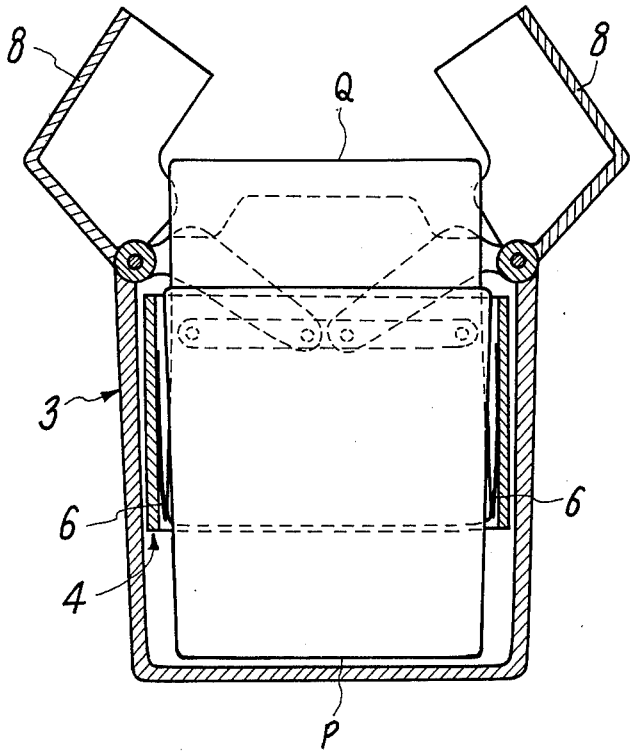
FIG. 9 is a cross-section view similar to FIG. 3, showing the relative position of the inner case when the cover is in opened position.

Then, as the cover 8 is opened, the inner case 4 rises as indicated by the arrow mark in the drawing and pulls up only said picked card Q engaging said gripping members 6,6, thus singling out the audience's selection Q from the entire deck of playing cards (See FIG. 9).

The present invention being constructed so that a given card picked by the audience is selectively caused to engage a pair of resilient members provided in the inner case of the box, it allows anyone, young and elderly, to play a card trick easily and without training. It is also clear that an added interest and mystery of the card trick is now provided by the present invention.

The construction of the card magic box according to the present invention has been described above but it will be apparent that many changes and modifications may be made without departing from the sprit and scope of the invention.

I claim as my invention:

1. A card magic box comprising:

a. a deck of uniformly-dimensioned playing cards, the configuration of which is such that either the top or the bottom edge of each card in the deck being slightly shorter than the other edge.

b. an outer housing which is open at the top for loading and unloading said deck of cards, and c. an inner case as disposed in said outer housing, said inner case being open at the top and bottom and having side walls defining an internal space which is generally conforming to the shape of the deck and in which said deck is freely movable in a vertical direction, said inner case further having, in said internal space and adjacent its side walls that would face the corresponding longitudinal edges of said deck of playing cards upon loading of the deck into the inner case, a pair of resilient members as juxtaposed at a spaced interval shorter than the longer of said top and bottom edges of said deck, said resilient member being so configured and disposed that when said deck of cards is loaded into the inner case, it does not act upon the cards (P) positioned the shorter lateral edge down but selectively act upon and grips the card or cards (Q) positioned the longer lateral edge down and that in response to the upward movement of the inner case, the latter card or cards (Q) only are automatically raised.

2. A card magic box as set forth in claim 1, wherein said outer case further includes a pair of cover members each rotatably mounted, at its base, adjacent the top of the corresponding side wall of the outer housing to open or close the same and a driving arm (10) extending downward from said base of each of said cover member and said inner case further includes a couple of horizontally extending slots (12) in its upper portion, the driving arms (10) engaging said slots in such a manner that the inner case is moved upward and downward in response to the swinging action of said cover members being opened and closed.

3. A card magic box as set forth in claim 1 wherein said resilient members are each formed of a flat resilient sheet material the width of which is substantially equal to the width of the side wall of said inner case, the base portion of each resilient member being secured to the corresponding side wall of the inner case, with the free depending end of said member being inwardly bent or displaced to provide a gap between the lower run of said resilient member and the corresponding side wall of the inner case and, thereby, to allow said free depending end to act as a gripping member.

* * * * *